US005979296A

United States Patent [19]

Kikuchi et al.

[11] Patent Number: 5,979,296

[45] Date of Patent: Nov. 9, 1999

[54] RECIPROCATING PUMP

[75] Inventors: Hideya Kikuchi; Etsuro Hozumi; Nobuo Aoki; Akinao Minegishi, all of Saitama-ken, Japan

[73] Assignee: Zexel Corporation, Tokyo, Japan

[21] Appl. No.: 08/951,541

[22] Filed: Oct. 16, 1997

[30] Foreign Application Priority Data

Oct. 16, 1996 [JP] Japan ..... 8-294425

[51] Int. Cl.[6] ..... F04B 19/22

[52] U.S. Cl. ..... 92/71; 92/86

[58] Field of Search ..... 92/60, 71, 81, 92/82, 83, 86, 142; 91/499; 417/269

[56] References Cited

U.S. PATENT DOCUMENTS

| | | | |
|---|---|---|---|
| 1,787,700 | 1/1931 | Persons | 92/86 X |
| 2,457,339 | 12/1948 | Bertea | 417/269 X |
| 3,744,377 | 7/1973 | Lauck | 92/86 X |
| 3,868,890 | 3/1975 | Roberts et al. | 92/86 |
| 3,973,473 | 8/1976 | Bate | 92/52 |
| 4,597,322 | 7/1986 | Garnjost et al. | 92/86 X |
| 4,858,439 | 8/1989 | Sawada et al. | 92/86 X |
| 5,415,531 | 5/1995 | Cavanaugh | 92/86 X |
| 5,655,778 | 8/1997 | Cavanaugh | 277/1 |
| 5,782,161 | 7/1998 | Okubo et al. | 417/269 X |

FOREIGN PATENT DOCUMENTS 6-43274 6/1994 Japan .

*Primary Examiner*—John E. Ryznic

[57] ABSTRACT

A communication path (32) for communicating a hermetically closed space (S) with an inlet port (20) is formed within a casing (1). An oil reservoir (30) having an inside capacity much greater than an inside capacity of the communication path (32) is formed in an intermediate part of the communication path (32).

4 Claims, 3 Drawing Sheets

RECIPROCATING PUMP

BACKGROUND OF THE INVENTION

This invention relates to a reciprocating pump. More particularly, the present invention relates to a reciprocating pump suited to be used as a pump for feeding gasoline to a gasoline engine.

Heretofore, a radial piston pump, a swash plate type pump, etc. have been known as a pump of this type. Those reciprocating pumps are designed such that by reciprocally moving a plunger (the term "plunger" in this invention includes a piston) provided in a cylinder bore of a cylinder member, oil is introduced into a pressure chamber and the oil thus introduced is pressurized.

In a reciprocating pump, a gap for allowing reciprocal strokes of the plunger is formed between an inner peripheral surface of the cylinder bore and an outer peripheral surface of the plunger. For this reason, there is an inconvenience that oil pressurized in the pressure chamber partly leaks outside from an opening portion of the cylinder bore through this gap. Especially, in case the oil to be pressurized is gasoline, lubricant, such as grease, to be applied to a rotating portion or sliding portion of the reciprocating pump is diluted by the gasoline leaked into the casing of the pump from the cylinder bore. As a result, there is a fear that seizing or the like will occur to the rotating portion or sliding portion.

To overcome this inconvenience, Japanese Utility Model Laid-Open Publication No. 43274/1994 discloses a reciprocating pump, in which a film (sealing member) expansible and contractible in response to reciprocal stroke of a plunger is provided between the cylinder member and the plunger such that the opening portion of the cylinder bore can be covered with the film, thereby defining a hermetically closed space by the cylinder member, the plunger and the film. Then, by receiving the gasoline leaked between the inner peripheral surface of the cylinder bore and the outer peripheral surface of the plunger into the hermetically closed space, the gasoline is prevented from leaking into the casing.

It should be noted here that if the above space is completely closed with respect to outside, the completely closed space is filled with the gasoline leaked and as a result, the film is ruptured or becomes unable to expand or contract. To overcome this inconvenience, in the pump disclosed in the above-mentioned Publication, the hermetically closed space is connected to a tank so that the gasoline leaked into the space can be returned to the tank.

However, for returning the gasoline to the tank, it becomes necessary to newly provide a piping between the casing and the tank. Therefore, the installing cost is increased to that extent. Moreover, much time and labor is required for piping operation. In addition, extra installation space is required for the piping.

SUMMARY OF THE INVENTION

According to the present invention, there is provided a reciprocating pump comprising a casing; a cylinder member provided within the casing; a plunger reciprocally movably provided in a cylinder bore of the cylinder member and adapted to discharge, under pressure, oil in a pressure chamber from an outlet port during a forward movement and introduce oil from an inlet port into the pressure chamber during a backward movement; and a sealing member expansible and contractible in the forward and backward directions of movement of the plunger, one and the other end portion of the sealing member being attached respectively to the cylinder member and the plunger, thereby defining a hermetically closed space surrounding an opening portion of the cylinder bore on the forward direction side of the plunger, a communication path for communicating the hermetically closed space with the inlet port being formed within the casing.

DETAILED DESCRIPTION OF THE EMBODIMENT

Figure 1:
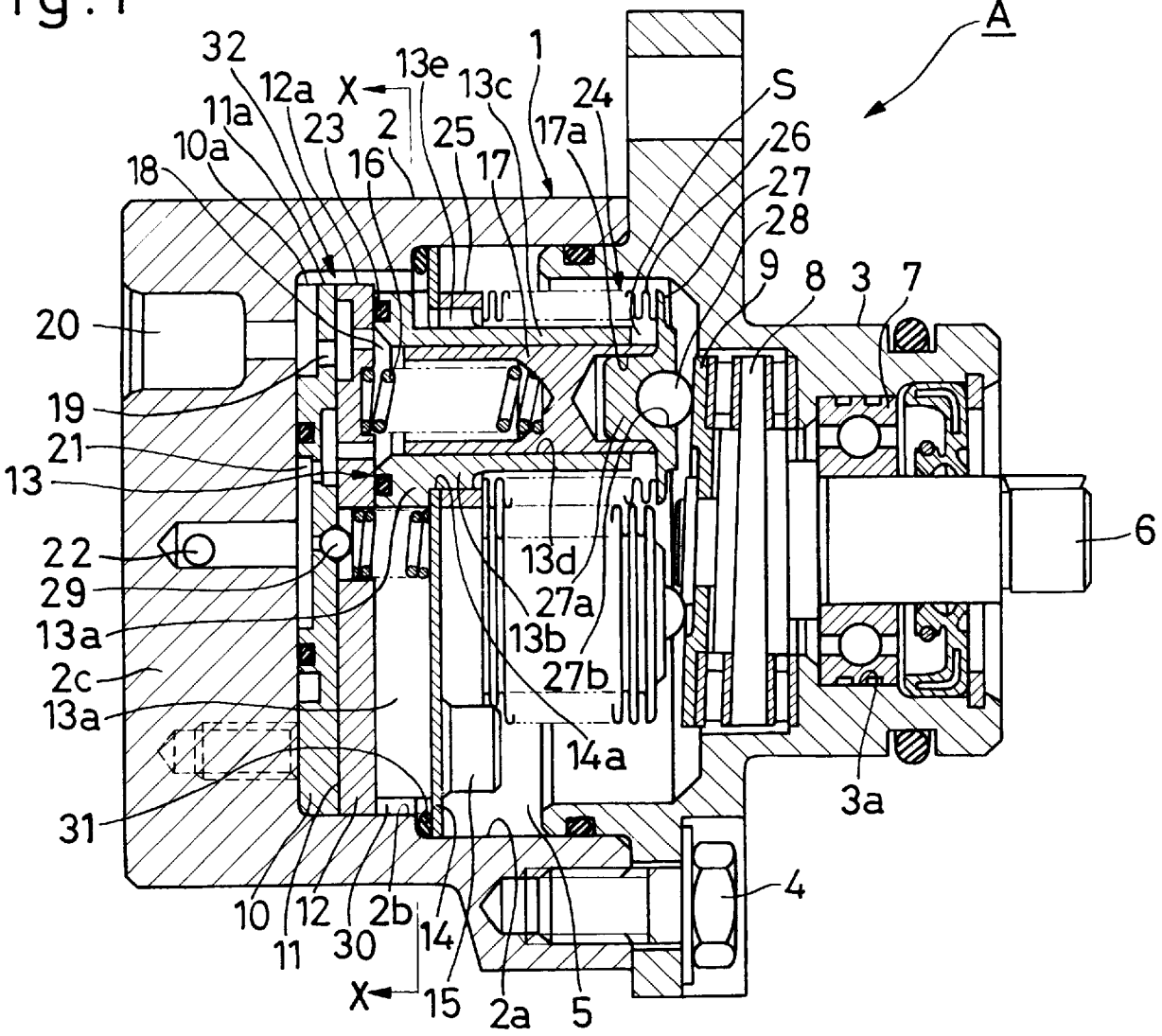
FIG. 1 is a vertical sectional view showing one embodiment of the present invention.
Figure 2:
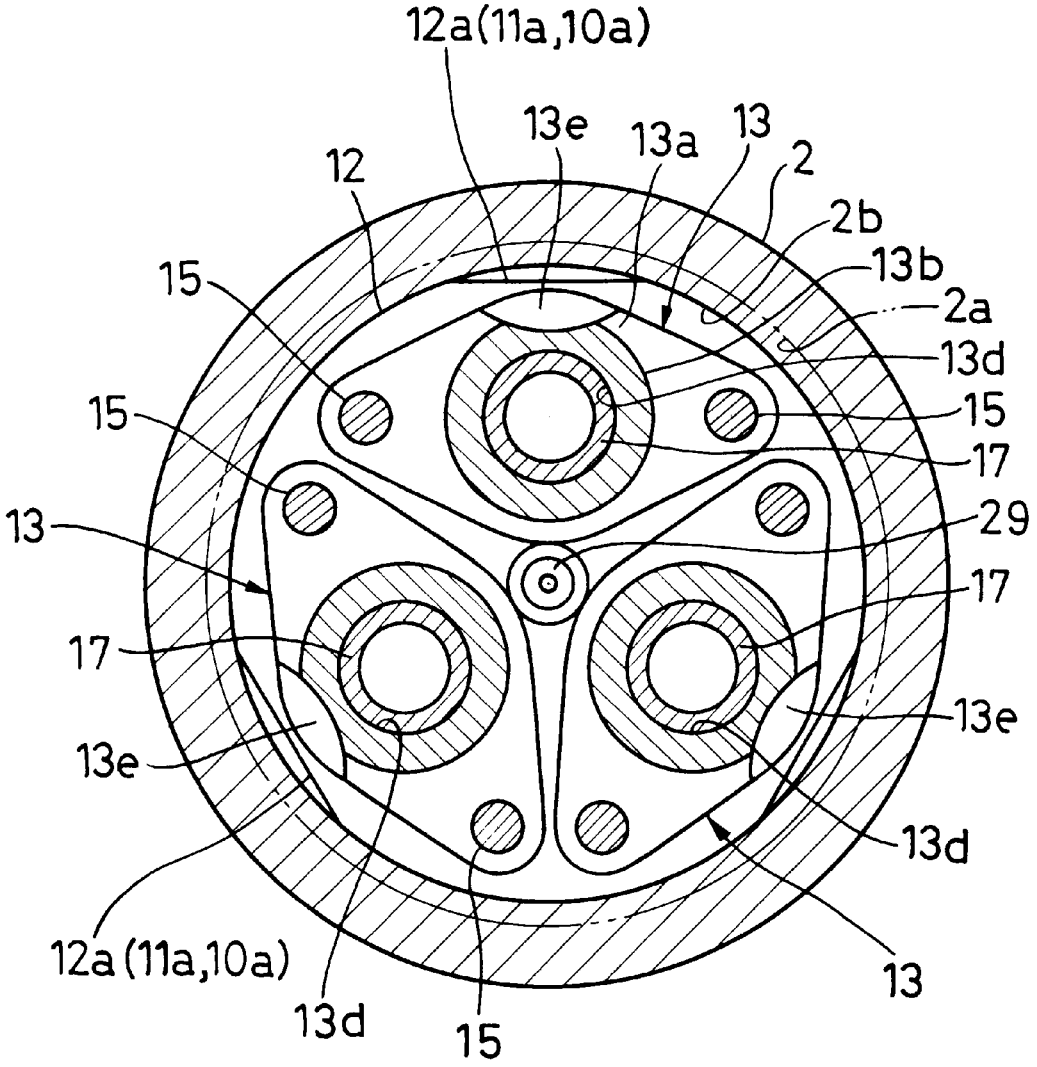
FIG. 2 is a sectional view taken on line X—X of FIG. 1.

One embodiment of the present invention will be described hereinafter with reference to FIGS. 1 through 3.

A reciprocating pump A of this embodiment is designed for pressurizing gasoline and feeding the pressurized gasoline to a fuel injection nozzle for a gasoline engine. As shown in FIGS. 1 and 2, the pump A includes a casing 1. This casing 1 comprises a body 2 and a lid member 3. An enlarged bore 2*a* and a reduced bore 2*b* each having a circular configuration in section are formed in a central portion of the body 2 in order from one end face 2*d* of the body 2 towards a bottom portion 2*c* such that the bores 2*a* and 2*b* are axially in alignment with each other. The lid member 3 is tightly secured to the end face 2*d* of the body 2 by a bolt 4. An opening portion of the enlarged bore 2*a* is closed by the lid member 3. Therefore, a receiving space 5, which is defined by the enlarged bore 2*a*, the reduced bore 2*b*, and the lid member 3 and hermetically closed with respect to outside, is formed within the casing 1.

A support bore 3*a* is formed in a central portion of the lid member 3 and extends all the way through the lid member 3. The support bore 3*a* is axially in alignment with the enlarged bore 2*a*. An input shaft 6, which is rotationally driven by a driving source such as an engine or the like, is rotatably inserted into the support bore 3*a* through a bearing 7. A cam plate portion 8 is integrally provided on an inner end portion of the input shaft 6. A swash plate 9 is relatively rotatably connected to the cam plate 8.

A disc-like plate 10, a leaf valve 11 formed of a thin circular plate, another disc-like plate 12, and three cylinder members 13 are inserted into the reduced bore 2*b* of the casing 1 in order. A disc-like support plate 14 is inserted into the enlarged bore 2*a*. The plate 10, the leaf valve 11, the plate 12, the cylinder member 13, and the support plate 14 are tightly secured to the bottom portion 2*c* by bolts 15 piercing therethrough. The plate 10, the leaf valve 11, and the plate 12 each have a generally same diameter as the reduced bore 2*b*. The support plate 4 has a generally same diameter as the enlarged bore 2*a*.

Figure 3:
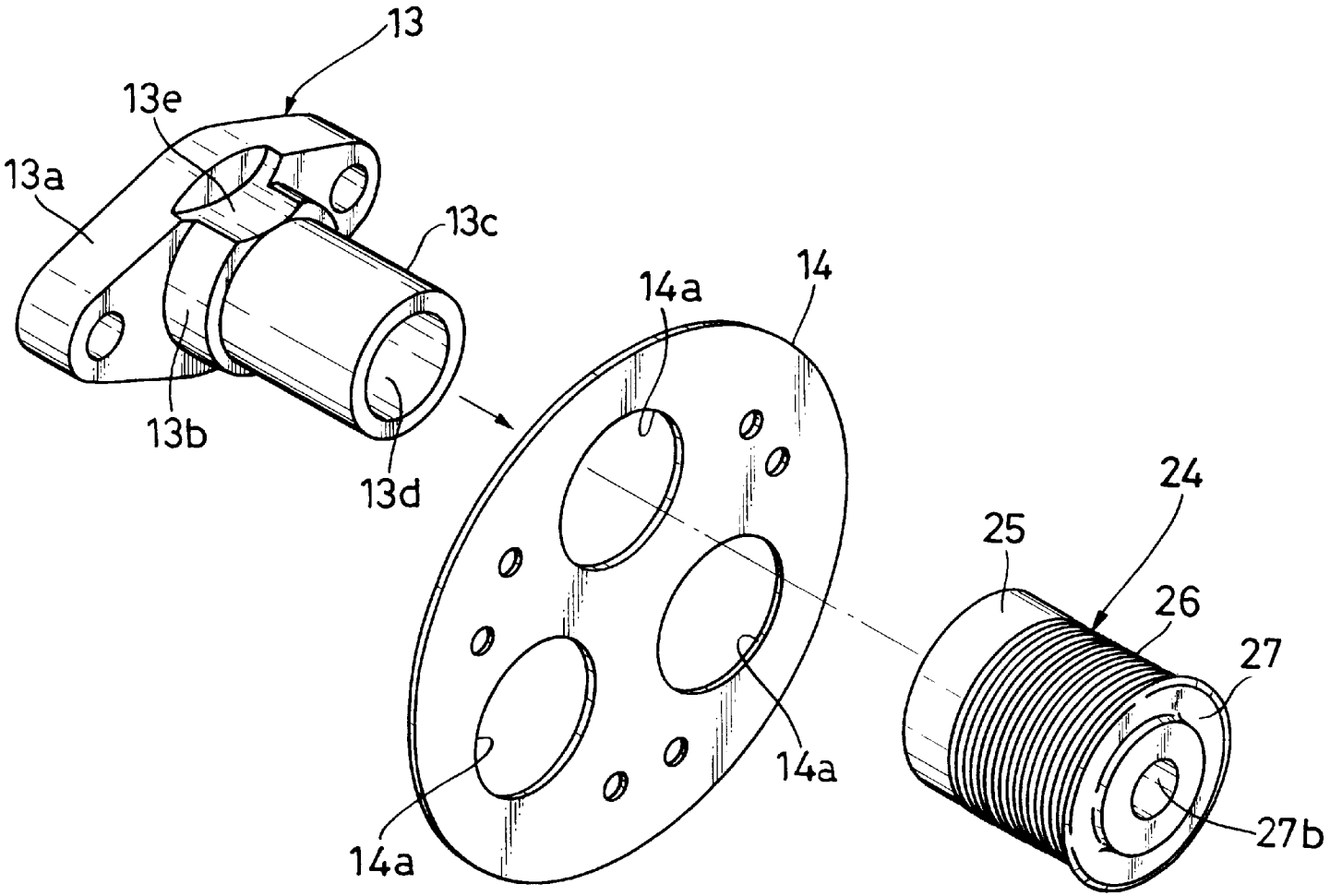
FIG. 3 is an exploded perspective view, showing a cylinder member, a support plate, and a sealing member used in the embodiment of FIG. 1.

As shown in FIG. 3, the cylinder members 13 (only one is shown in FIG. 3) each include a diamond-like seating 13*a*. The three cylinder members 13 are equally spacedly arranged in a circumferential direction of the reduced bore 2*b*. The seating 13*a* of each cylinder member 13 is such dimensioned in thickness that one end face of the seating 13*a* projects inside the enlarged bore 2*a*. An enlarged diameter portion 13*b* is formed on a central portion of the above-mentioned end face of the seating 13*a*. A reduced diameter portion 13*c* is formed on a distal end face of the enlarged diameter portion 13*b* such that the portion 13*c* is coaxial with the portion 13*b*. A cylinder bore 13*d* is formed in a central portion of the cylinder member 13. The cylinder bore 13*d* extends all the way through the seating 13*a*, the enlarged diameter portion 13*b*, and the reduced diameter portion 13*c*.

A plunger 17 is slidably inserted into the cylinder bore 13*d*. The plunger 17 is biased by a spring 16 towards the lid member 3. An internal space of the cylinder bore 13*d*, which is defined by the plunger 17 and the plate 12, is served as a pressure chamber 18. The pressure chamber 18 is hermetically closed by a sealing member 23 such as an O-ring or the like provided between the plate 12 and the cylinder member 13 with respect to the receiving space 5.

The pressure chamber 18 is communicated with an inlet port 20 through an inlet path 19 formed in the plates 10 and 12, and with an outlet port 22 through an outlet path 21 formed in the plates 10 and 12. The inlet path 19 and the outlet path 21 are opened and closed by the leaf valve 11. Since a mechanism for opening and closing the inlet path 19 and the outlet path 21 using the leaf valve 11 is known per se, detailed description thereof is omitted. When the plunger 17 is caused to move towards the lid member 3 by the spring 16, the inlet path 19 is opened and the outlet path 21 is closed. Therefore, gasoline is introduced into the pressure chamber 18 from the inlet port 20 through the inlet path 19. When the plunger 17 is moved towards the bottom portion 2*c* against the biasing force of the spring 16, the inlet path 19 is closed and the outlet path 21 is opened. Therefore, the gasoline pressurized in the pressure chamber 18 is discharged to the outlet port 22 through the outlet path 21.

Three through-holes 14*a* are equally spacedly arranged in the support plate 14. The through-holes 14*a* each have a generally same diameter as the enlarged diameter portions 13*b*. The enlarged diameter portions 13*b* are inserted into the corresponding through-holes 14*a*, respectively.

Three sealing members 24 are arranged on the opposite end face of the support plate 14 to the above-mentioned end face on the side of the cylinder members 13. Each sealing member 24 comprises a cylindrical member 25 having a generally same inside diameter as the through-holes 14*a*, a metal bellows 26 arranged coaxial with the cylindrical member 25 and firmly secured to a distal end face of the cylindrical member 25 by welding or the like, and a bottom member 27 firmly secured to a distal end portion of the bellows 26 by welding or the like and adapted to close an opening portion at the distal end thereof. The cylindrical members 25 are firmly secured to the support plate 14 by welding or the like such that the cylindrical members 25 are coaxial with the through-holes 14*a*, respectively. By doing so, the sealing members 24 are firmly secured to the support plate 14. The sealing members 24 can be expanded and contacted at the bellows 26, respectively.

An internal space of each sealing member 24 defined by an inner peripheral surface of the cylindrical member 25, an inner peripheral surface of the bellows 26, and the bottom member 27 is open to outside through the through-hole 14*a* of the support plate 14. The through-holes 14*a* are closed by the seating 13*a*, respectively. Therefore, the internal space of each sealing member 24 is sealed with respect to the receiving space 5 and served as a hermetically closed space S. This hermetically closed space S surrounds an opening portion of the cylinder bore 13*d* on the reduced diameter portion 13*c*. Owing to this arrangement, the gasoline leaked from between the inner peripheral surface of the cylinder bore 13*d* and the outer peripheral surface of the plunger 17 is reserved in the hermetically closed space S.

The plunger 17 is abutted against the bottom member 27 by the spring 16. A projection 27*a* is formed on one end face of the bottom member 27 where the plunger 17 is abutted. On the other hand, a recess 17*a* is formed in the plunger 17. By fitting the projection 27*a* into the recess 17*a*, the bottom member 27 is prohibited from displacing in a direction perpendicular to the axial direction of the plunger 17. It is also accepted that a recess is formed in the bottom member 27 and a projection is formed on the plunger 17. A support recess 27*b* is formed in the other end face of the bottom member 27 opposing the swash plate 9. A spherical member 28 is fitted in the support recess 27*b*. The spherical member 28 is biased against and contacted with the swash plate 8 by the spring 16 through the bottom member 27.

With the above-mentioned construction, when the input shaft 6 is rotationally driven, each plunger 17 is reciprocally moved by the cam plate 8 and the spring 16. When the plunger 17 is moved forwardly against the biasing force of the spring 16, the gasoline (oil) in the pressure chamber 18 is pressurized. The gasoline thus pressurized is discharged to the outlet port 22 through the outlet path 21 and then transferred to a fuel injection nozzle (not shown). On the other hand, the plunger 17 is moved backwardly by the biasing force of the spring 16, the gasoline in the inlet port 20 is introduced into the pressure chamber 18 through the inlet path 19.

When the pressure in the pressure chamber 18 is raised equal to or higher than a prescribed level, the gasoline flows into an oil reservoir 30, as later described, through a relief valve 29 and then returned to the inlet port 20. Therefore, the pressure of the pressurized gasoline is not exceed the prescribed level.

A very small part of the gasoline pressurized in the pressure chamber 18 leaks to the hermetically closed space S through an unavoidable small gap formed between the inner peripheral surface of the cylinder bore 13*d* and the outer peripheral surface of the plunger 17. If such gasoline is left as it is, the hermetically closed space S is filled with the gasoline and the sealing member 24 becomes unable to expand and contract. So, in this pump A, the gasoline leaked into the hermetically closed space S is returned to the inlet port 20. If, however, the gasoline is merely returned to the inlet port 20, the gasoline in the hermetically closed space S is increased or decreased in pressure in accordance with the expansion and contract of the sealing member 24. This causes the pressure in the inlet port 20 to be pulsated possibly to give an adverse effect to the introduction of the gasoline into the pressure chamber 18 during the backward stroke of the plunger 17. Therefore, in this pump A, an oil reservoir 30 is provided between the hermetically closed space S and the inlet port 20.

The above content is described in more detail. First, the oil reservoir 30 is described. There exist three seatings 13*a* for three cylinder members 13 between the plate 12 and the support plate 14. As apparent from FIG. 2, a total volume of the three seatings 13*a* is smaller than the inside capacity of the enlarged bore 2*a* and the reduced bore 2*b* which exist between the plate 12 and the support plate 14. Therefore, between the plate 12 and the support plate 14, a space having a size equivalent to a value obtained by removing the volume of the three seatings 13*a* from the inside capacity of the enlarged bore 2*a* and the reduced bore 2*b* provided between the plate 12 and the support plate 14, is formed. This space is served as the oil reservoir 30. This oil reservoir 30 is hermetically closed by a sealing member 31 such as an O-ring or the like disposed between the support plate 14 and the bottom surface with respect to a part of the receiving space portion 5 from the support plate 14 to the lid member 3.

A communication path for communicating the hermetically closed space S with the inlet port 20 is described next. Cuts 13*e* are formed in the cylinder member 13. One end of each cut 13*e* is formed on an outer periphery of the enlarged diameter portion 13*b* and faces the hermetically closed space S. The other end of each cut 13*e* is formed in each seating 13*a* and faces the oil reservoir 30. Owing to this arrangement, the hermetically closed space S and the oil reservoir 30 are communicated with each other through each cut 13*e*. Cuts 10*a*, 12*a*, 11*a* are formed in the outer peripheral surfaces of the plates 10, 12 and the leaf valve 11, respectively. The respective cuts 10*a*, 12*a* and 11*a* are formed in the same position in the circumferential direction. The cut 12*a* is in communication with the oil reservoir 30, and the cut 11*a* is in communication with the inlet path 19. Therefore, the reservoir 30 is in communication with the inlet path 19 through the cuts 12*a*, 11*a* and 10*a*, and with the inlet port 20 through the inlet path 19. As apparent from this, a communication path 32 for communicating the hermetically closed space S with the inlet port 20 is formed by the cuts 10*a*, 11*a*, and 12*a*. Here, the inside capacity of the oil reservoir 30 is of course set to be larger than the capacity of the cut 13*e*, and the sum of the capacity of the cuts 10*a*, 11*a* and 12*a*. The inside capacity of the oil reservoir 30 is also set to be much larger than the total of the capacity of all the cuts 13*e*, 10*a*, 11*a*, and 12*a*.

In the reciprocating pump A thus constructed, since the hermetically closed space S is in communication with the inlet port 20, the gasoline leaked into the hermetically closed space S can be returned to the inlet port 20. In this case, since the communication path 32 for communicating the hermetically closed space S with the inlet port 20 is formed within the casing 1, there is no need of a provision of a piping for returning gasoline to the tank, which piping is required in the conventional reciprocating pump. Therefore, the installing cost can be reduced to that extent. Moreover, the time and labor required for installing the piping can be eliminated. In addition, the installation space can be reduced.

Because the oil reservoir 30 having a much larger capacity than that of the communication path 32 is provided on an intermediate part of the communication path 32 for communicating the hermetically closed space S with the inlet port 20, it is possible to reduce the pulsation of pressure in the inlet port 20, which pulsation is caused by returning the gasoline leaked into the hermetically closed space S, to the inlet port 20. Thus, possible adverse effect (such as, for example, if the pressure in the inlet port 20 becomes negative during backward stroke of the plunger, introduction of gasoline into the pressure chamber 18 is difficult to be performed smoothly), which is caused by the pulsation of pressure in the inlet port 20, can be prevented from occurring.

Especially, in the pump A of this embodiment, three sealing members 24 are provided in much with a provision of three cylinder bores 13*d* and three plungers 17, and the hermetically closed spaces S are communicated with the oil reservoir 30. Owing to this arrangement, when gasoline is discharged into the oil reservoir 30 from the hermetically closed space S of one of the sealing members 24, the gasoline in that oil reservoir 30 is drawn into the hermetically closed spaces S of the remaining sealing members 24. Therefore, when the pressure in the oil reservoir 30 is increased by the gasoline discharged by one of the sealing members 24, this increase of pressure is offset by decrease of pressure in other oil reservoir 30 caused by gasoline drawn into other sealing member 24. By this, pulsation of the pressure of the oil reservoir 30 itself can be reduced. Therefore, pulsation of the pressure in the inlet port 20 can be more reduced.

It should be noted that the present invention is not limited to the above-mentioned embodiment and that many changes in design can be made in accordance with necessity.

For example, in the above-mentioned embodiment, the present invention is applied to a swash plate type reciprocating pump A. However, the present invention is likewise applicable to the radial piston type reciprocating pump disclosed in the previously mentioned Japanese Utility Model Laid-Open Publication 43274/1994. Also, the present invention can be applied to a reciprocating pump for pressurizing oil other than gasoline.

The sealing member should not be limited to the sealing member 24 comprising the bellows 26. A film may also be used as the sealing member as disclosed in the above-mentioned Publication. Although the sealing member 24 is secured to the cylinder member 13 through the plate 14 in the above-mentioned embodiment, it may be secured directly to the cylinder member 13.

What is claimed is:

1. A reciprocating pump comprising a casing; a cylinder member provided within said casing; a plunger reciprocally movably provided in a cylinder bore of said cylinder member and adapted to discharge, under pressure, oil in a pressure chamber from an outlet port during a forward movement and introduce oil from an inlet port into said pressure chamber during a backward movement; and a sealing member expansible and contractible in the forward and backward directions of movement of said plunger, one and the other end portion of said sealing member being attached respectively to said cylinder member and said plunger, thereby defining a hermetically closed space surrounding an opening portion of said cylinder bore on the forward direction side of said plunger, a communication path for communicating said hermetically closed space with said inlet port being formed within said casing.

2. A reciprocating pump according to claim 1, wherein said sealing member includes a bellows expansible and contractible in the forward and backward direction of movement of said plunger.

3. A reciprocating pump according to claim 1 or 2, wherein said casing is formed therein with an oil reservoir which is in communication with an intermediate portion of said communication path, an inside capacity of said oil reservoir being larger than an inside capacity of a communication path leading from said hermetically closed space to said oil reservoir.

4. A reciprocating pump according to claim 3, which comprises a plurality of said cylinder bores, a plurality of said plungers, and a plurality of said sealing member, a plurality of said hermetically closed spaces being defined respectively by said sealing members, each of said communication paths being formed between each of said hermetically closed spaces and said inlet port, each of said communication paths being in communication with a single oil reservoir.

* * * * *